United States Patent [19]

D'Agosta

[11] Patent Number: 4,605,221

[45] Date of Patent: Aug. 12, 1986

[54] EXERCISE METHOD AND APPARATUS

[76] Inventor: Nino D'Agosta, 3502 S. 66th St., Omaha, Nebr. 68106

[21] Appl. No.: 648,767

[22] Filed: Sep. 10, 1984

Related U.S. Application Data

[63] Continuation-in-part of Ser. No. 360,442, Mar. 22, 1982.

[51] Int. Cl.[4] ..... A63B 21/06; A63B 5/00

[52] U.S. Cl. ..... 272/117; 272/67; 272/DIG. 5

[58] Field of Search ..... 272/116, 117, 124, DIG. 5, 272/67, DIG. 4, 125, 129, DIG. 6, 901; 73/379; 200/61.45, 61.48, 61.52; 273/1 GC; 340/573

[56] References Cited

U.S. PATENT DOCUMENTS

| | | | |
|---|---|---|---|
| 3,094,324 | 6/1963 | Shingleton | 272/117 |
| 3,204,233 | 8/1965 | Olliff | 200/61.52 |
| 3,351,346 | 11/1967 | Strahan | 272/124 |
| 3,414,260 | 12/1968 | Gust | 272/124 |
| 3,424,005 | 1/1969 | Brown | 73/379 |
| 3,690,655 | 9/1972 | Chapman | 272/67 |
| 3,766,538 | 10/1973 | Dealy | 340/573 |
| 3,885,576 | 5/1975 | Symmes | 340/573 |
| 3,929,335 | 12/1975 | Malick | 272/129 |
| 3,960,376 | 6/1976 | Berlin | 273/1 GC |
| 4,257,591 | 3/1981 | Evans | 272/DIG. 4 |

OTHER PUBLICATIONS

"Incredible Feats of Slim Farman", Stength & Health, p. 28, Feb.-Mar. 1975.

"The Old Weaver Stick Lift", Strength & Health, p. 56, May 1973.

*Primary Examiner*—Richard J. Apley

*Assistant Examiner*—S. R. Crow

*Attorney, Agent, or Firm*—Zarley, McKee, Thomte, Voorhees & Sease

[57] ABSTRACT

A method and apparatus for strengthening one's grip, wrist, arms and back includes providing a multi-leg exercise device having an upward extension for receiving light incremental disc weights, placing weights on the extension, positioning the device on a flat surface with two adjacent legs engaging the surface and defining a pivot axis therebetween, gripping one of the legs and rotating the device through a 90° arc between a lying stable position and standing stable position.

11 Claims, 13 Drawing Figures

EXERCISE METHOD AND APPARATUS

CROSS REFERENCE TO RELATED APPLICATION

This is a continuation-in-part of copending patent application Ser. No. 360,442, filed on Mar. 22, 1982.

BACKGROUND OF THE INVENTION

This invention relates to a new sport involving a method of exercising one's grip, wrists, arms and back and to an exercise device used in such exercises.

The use of weight training devicies has long been established as beneficial in improving one's strength and muscle development. Competition between users of weight training equipment is frequent and tests of strength and endurance are shown throughout recorded history. Recently, for example, the sport of arm wrestling has enjoyed a resurgence in popularity.

Most weight devices rely upon the gravitational attraction of the weights working against the user's muscles to place stress on that particular musucle group. Since the gravitational pull on earth is fairly constant worldwide, it is possible for a comparison to be made between competitors using similar weights (mass). For example, two people at different locations, both lifting one hundred pound weights, can compare their relative strengths against one another. Such constancy allows for competition in weight training and provides a source of entertainment in the testing of one's skill and strength.

Of all of the weight training devices presently known, most rely upon either the actual lifting of the weight or lifting the weight with the guidance of pulleys, cables, or other means to ensure uniformity in strictness of movement. In some cases, to accurately compare exercises and thereby compare strength, it is necessary for certain rules to be established with respect to how the exercises are conducted. For example, when one wishes to curl a bar having weights attached to test the strength of one's biceps, it is possible to eliminate additional assistance from other muscle groups by requiring that the participant place his back against the wall before performing the curl exercise.

Although many exercises have been developed for lifting weights, there are few actual devices which allow for developing specific groups of muscles. The instant invention is directed to a device which helps to develop the strength in one's hands, wrists as well as muscles in one's arms and back.

Known wrist exercisers include a rope secured to weights at one end and connected to the middle of a round wood handle at the other end. The rope is wrapped onto or from the handle upon rotation of the handle thereby raising and lowering the weight. The weight is not adjustable, however, and operation of the device requires two hands. Some weight training machines include a rotatable handle with adjustments for varying resistance but these are generally part of a large, expensive and permanent installation.

Stunts have been known wherein an axe or sledge hammer is gripped at the handle end and pivoted to demonstrate wrist strength. But such tools have a nonvariable weight and are both unstable and dangerous in their upright position.

The present invention allows for a number of different exercises as well as a particular competitive form of utilizing the device thereof. The invention also strengthens the muscles used in golf, tennis, racketball and other sports. A particularly important aspect of the invention is that it is a new sport itself, and new methods of competing have been developed and disclosed herein. The sport is called GWRAB, as it utilizes the grip (G), wrist (WR), arms (A) and back (B).

As exercise devices become more complex, thereby expensive, there exists a need for a simple device that allows for weight training and competition and the development of strength in specific muscle groups. The instant invention is directed toward that need.

SUMMARY OF THE INVENTION

A primary object of the invention is to provide an improved weight training method and device which allow one to develop the strength in the grip, wrist, arms and back.

Another object is to provide a new sport wherein all athletes, men and women, can nonagressively compete against others in their own weight categories.

It is another object of the invention to provide a weight training method and device wherein the resistance is provided by a plurality of light incremental weights.

It is another object of the invention to provide a weight training method and device wherein the weights are moved between safe stable positions at both the raised and lowered extents of movement of the exercise.

It is another object of the instant invention to provide a weight training device having a plurality of elongate members joined at an apex and providing a situs for the attachment of weights.

It is another object of the instant invention to provide a device which can be used with removably attached weights thereby adjusting the resisting force utilized in developing one's strength.

It is another object of the invention to provide a device for use in competition between individuals as well as teams.

It is another object of the invention to provide such a device which is lightweight, portable and easy to use on any substantially flat surface.

It is a still further object of the instant invention to provide a weight supporting frame means having a fulcrum for pivoting the weight from the vertical to the horizontal and from the horizontal to the vertical.

It is yet still a further object of the invention to provide a device which can be used to improve one's performances in golf, tennis, racketball and other sports.

It is a final object of the invention to provide a new weight training method using a device which is simple and rugged in construction, economical to manufacture and efficient in operation.

DESCRIPTION OF THE PREFERRED EMBODIMENTS

Figure 1:
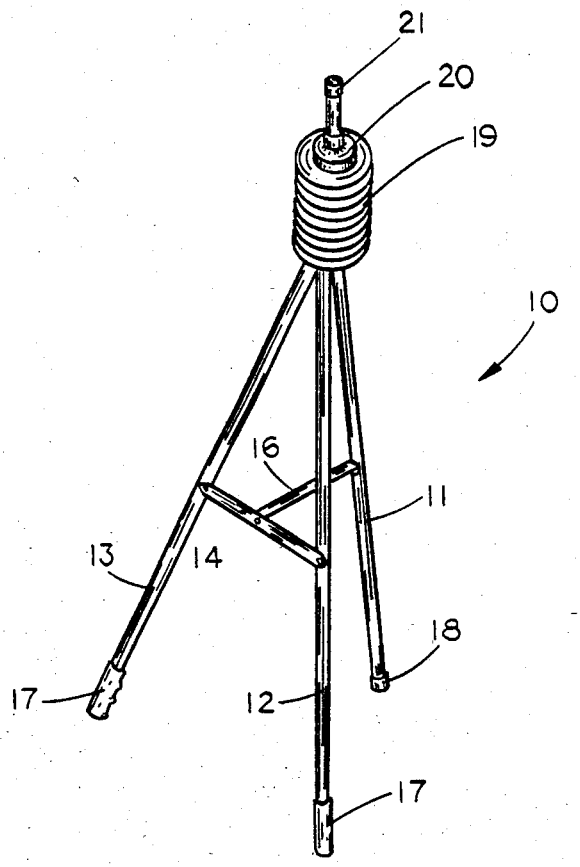
FIG. 1 is a perspective view of the device.

The method and apparatus to be discussed in detail below are unique in both the construction and use. As can be seen in FIG. 1, the exercise device 10 is generally comprised of elongate members 11, 12 and 13 which are connected together adjacent the upper ends thereof. An elongated extension 23 projects upwardly from the connected upper ends of the elongate members. Weights 19 are placed on extension 23 and a weight collar 20 is installed to prevent the weights 19 from slipping off of the elongate extension 32. The weights are supported in stacked relation on the upper ends of the second and third elongate members 12 and 13 with extension 23 extended through the center openings of the weights. Stiffening members comprised of brackets 14 and 16 are attached between elongate members 11, 12 and 13 to provide structural integrity. Hand grips 17 are placed on the lower end of elongate members 12 and 13 to provide a gripping surface and protective cup 18 is placed on the lower end of elongate member 11.

Figure 2:
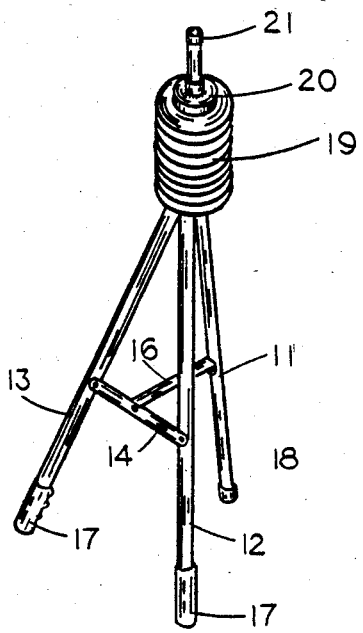
FIG. 2 is a perspective view of a second embodiment of the device in which the elongate supporting members are shorter in length than in the embodiment shown in FIG. 1.

In FIG. 2, the identical components are shown although it will be noted that elongate members 11, 12 and 13 are shortened and stiffening members 14 and 16 are in a slightly different position with respect to elongate members 11, 12 and 13.

FIG. 1 depicts the larger model which it is contemplated would be used for adults, primarily men, whereas the smaller model as depicted in FIG. 2 would be utilized by children and women and possibly men who could not utilize the larger model, due to limitations in their strength.

Figure 9:
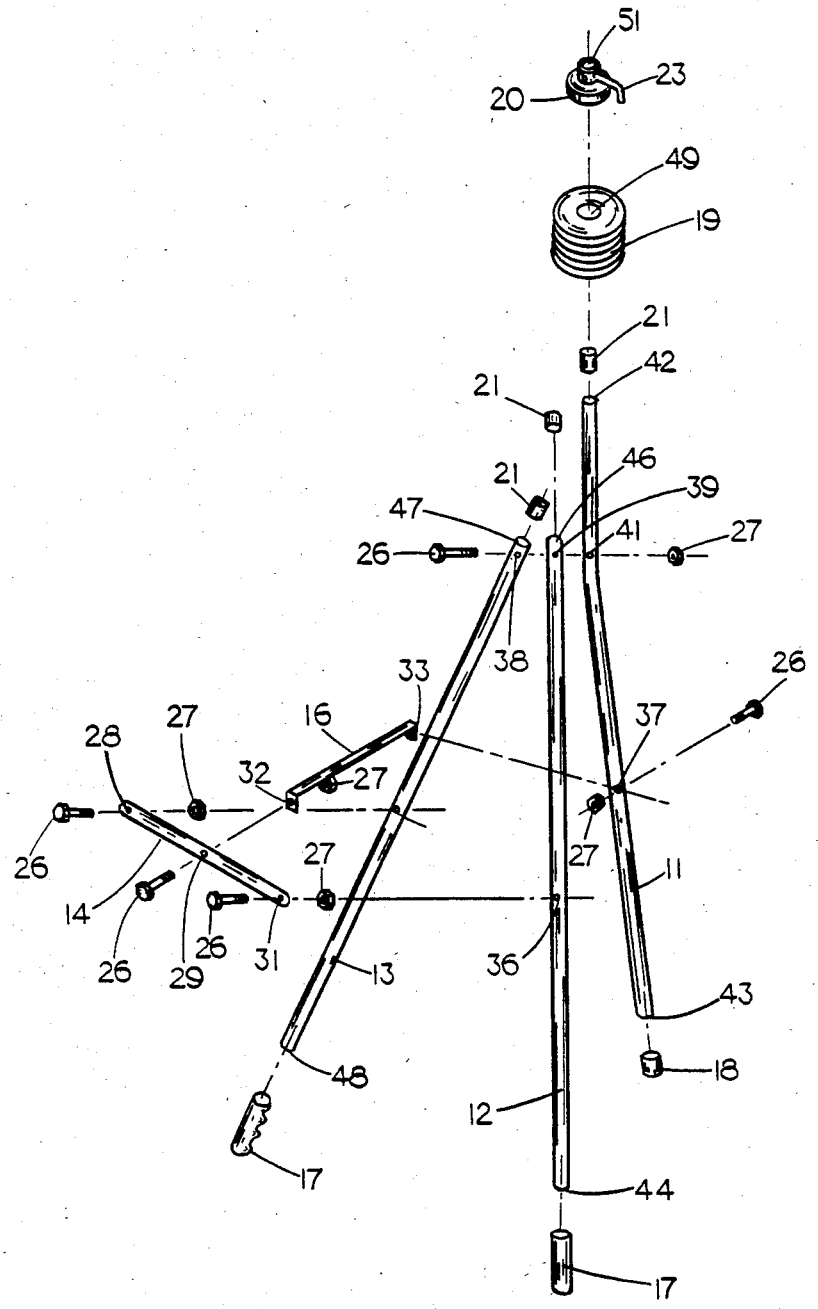
FIG. 9 is an exploded perspective view of the device depicting the component parts thereof.

In FIG. 9 all of the component parts of the device 10 can be seen in greater detail. Elongate member 12 is a hollow tube or rod, such as an electrical conduit, which has an upper end 46 and lower end 44. Elongate member 12 optimally is between two and four feet long and is approximately three feet long in the preferred embodiment. Hole 36 is provided in elongate member 12 at a point between upper end 46 and lower end 44. Elongate member 13 is identical to elongate member 12 in that it is provided with an upper end 47 and a lower end 48 and a hole 34.

Elongate member 11 is made of the same material as members 12 and 13 and is provided with upper end 42 and lower end 43. For ease of construction, however, elongate member 11 is slightly longer than elongate member 12 and 13 and can be bent so that upper end 42 becomes the extension 23 and projects upwardly substantially normal to the flat base surface when members 11, 12 and 13 have their lower ends engaging the base surface.

Holes 41, 39 and 38 are drilled in elongate members 11, 12 and 13 respectively to provide for joining of elongate members 11, 12 and 13 by use of bolt 26 and nut 27. The distance from that point of attachment to the lower terminus ends 43, 44 and 48 is nearly identical. Thus, the distance between lower end 43 on elongate member 11 and hole 41 would be the same as the distance between lower end 44 of elongate member 12 and hole 39 and so on.

Upper ends 47, 46 and 42 in elongate members 13, 12 and 11 respectively are provided with caps 21 which are cylindrical in shape having an upper portion which seals off the opening in elongate members 11, 12 and 13. The lower ends of elongate members 11, 12 and 13 are also provided with caps. The lower end 43 of elongate member 11 is provided with cap 18 which is similar in construction and utilization to caps 21. The lower ends 44 and 48 of members 12 and 13 are each provided with a hand grip cap 17 which provides a gripping surface for the use of the device 10.

Weights 19 are preferably provided as a plurality of flat disc type washers having a center opening or hole 49 adapted for receiving upper extension 42 of elongate member 11. Discs 19 are light incremental weights of a size and shape such that a stack of ten discs 19 stands ½ inches tall and weights one pound. In the preferred embodiment wherein the lowermost weight would be supported at a height of approximately 36 inches above the support surface when the device is standing upright, it has been found that approximately 70 disc weights provide ample resistance for the strongest of users.

Weight collar 20 has a center hole 51 and tightening screw 53 for removably securing weights 19 onto extension 21.

Brace 14 is an elongate member having holes 28, 29 and 31 in which bolts 26 are inserted to co-act with holes 34 and 36 in members 13 and 12 and hole 32 in bracket no. 16. Nuts 27 are utilized on bolts 26 to securely fasten brace 14 to elongate members 12, 13 and 16. Brace 16 is provided with holes 32 and 33 in which bolts 26 can be inserted to attach brace 16 through hole 37 in elongate member 11 and through hole 29 in brace 14.

Figure 10:
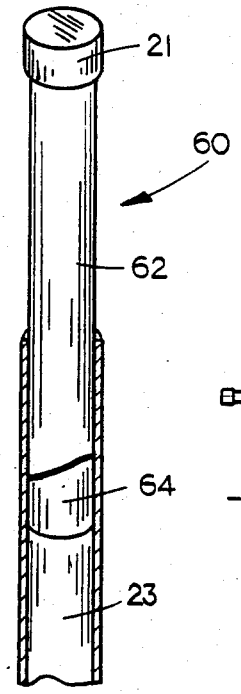
FIG. 10 is an enlarged detail side view, partly in section, of the telescoping weight-receiving extension.

FIG. 10 illustrates an accessory 60 for extending the length of extension 21 to accommodate additional weights 19. Specifically, accessory 60 includes an inner tube 62 of a diameter for being telescopically slidably received in tubular extension 23. Cap 21 is fitted onto the upper end of inner tube 62, the lower end of which is provided with a rotary cam lock 64 of the type used on adjustably extendable tent poles. The cam lock 64 serves to releasably fix the inner tube 62 at selected positions relative to outer tube 23 for extending the extension 23 to accommodate an increased number of weights 19.

Figure 11:
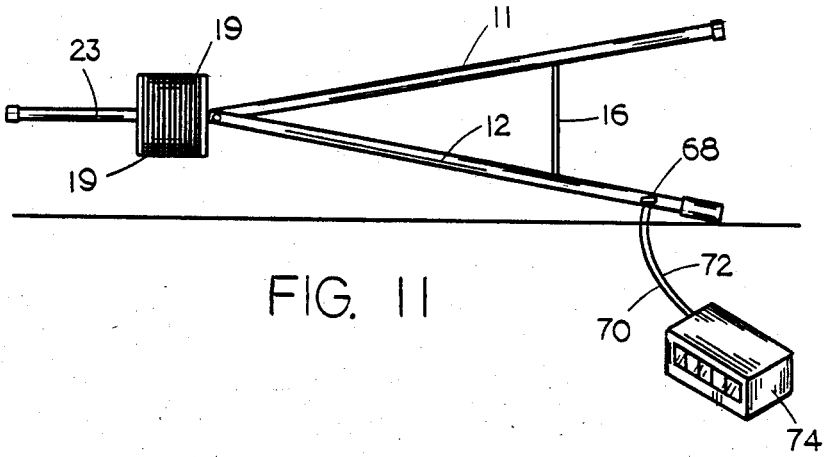
FIG. 11 is a side elevational view of the device with an inclination sensitive switch thereon.
Figure 13:
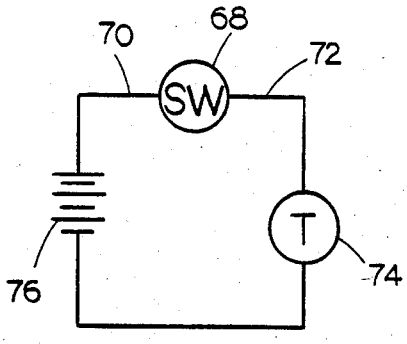
FIG. 13 is an electrical schematic circuit diagram for the inclination sensitive switch.
Figure 12:
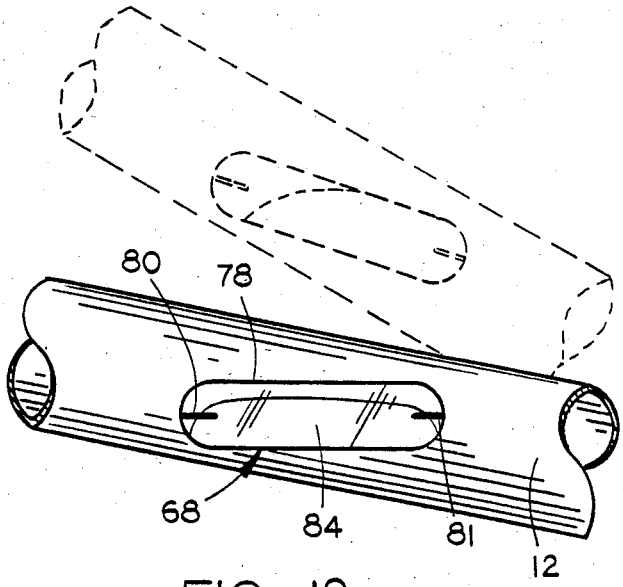
FIG. 12 is an enlarged detail side view of the inclination sensitive switch.

FIG. 11 shows the exercise device 10 in a generally horizontal position but with the weights suspended in clearance relation above the flat support surface 66 approximately three inches, for example. An inclination sensitive electrical switch 68 is secured to the device 10 for indicating that the weights have been lowered to a predetermined position such as that illustrated in FIG. 11. Switch 68 is connected by wires 70 and 72 to an electronic timer 74 which may be powered by batteries 76 as indicated in the circuit diagram of FIG. 13. Switch 68 is shown in FIG. 12 as a mercury switch including a bulb 78 having contact terminals 80 and 82 at the opposite ends thereof and a body of mercury 84 supported therein for movement from the solid line switch closed position to the dotted line switch open position in response to pivotal movement of device 10.

Figure 3:
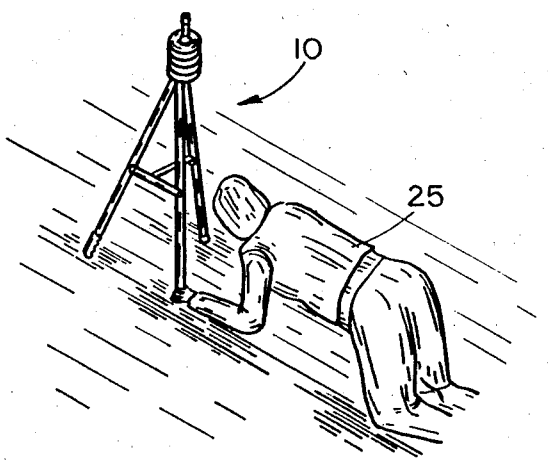
FIG. 3 is a perspective view of the device setting on a flat surface and a user using the device by gripping it at one end.
Figure 4:
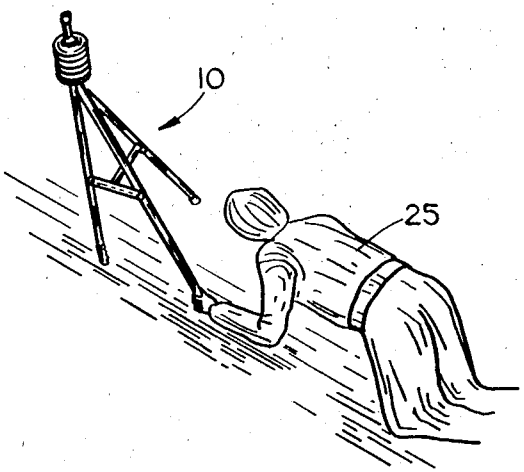
FIG. 4 is a perspective view of the device in use showing the user pivoting the device about a fulcrum created by the ends of two of the elongate members.
Figure 5:
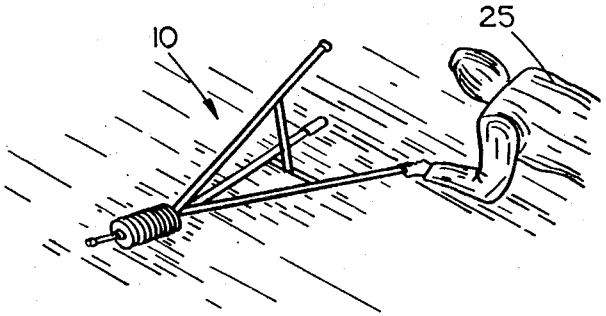
FIG. 5 is a perspective view of the device showing the user having pivoted the device to the horizontal position.

The use of the device 10 will now be described. There are two major types of exercises using the device 10. The first is depicted in FIGS. 3, 4 and 5. In this exercise the user 25 grips the device 10 from the vertical to the horizontal while the rotation of the device 10 on the flat surface is about a fulcrum which is colinear with the user's forearm 92. Specifically, the fulcrum or pivotal axis 90 is that imaginary line which extends between the points of intersection of the flat surface 66 with the lower end 44 and 48 of legs 12 and 13. As the device 10 is moved from the vertical to the horizontal, the pull of the weights 19 become greater and more strength is required in order to keep the device 10 from totally reaching the horizontal. When the device 10 has reached the horizontal or so near that the weights 19 are nearly touching the flat surface, then the user 25 reverses the position and returns the device 10 from the horizontal to the vertical. As greater amounts of weights 19 are placed on the device 10, the exercise becomes more difficult.

Figure 6:
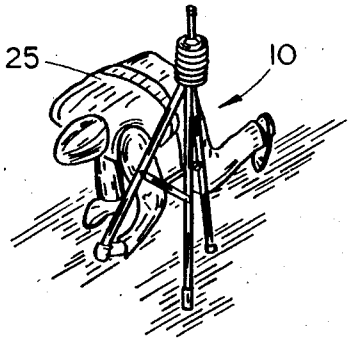
FIG. 6 is a perspective view of the user depicting yet another exercise with the device in which the user is gripping the device in a vertical position.
Figure 7:
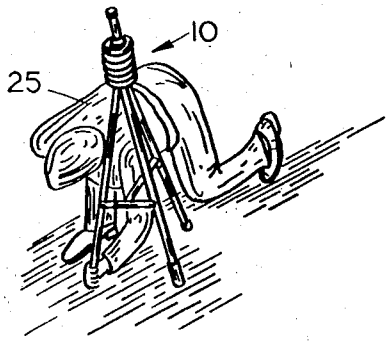
FIG. 7 is a perspective view of the device in use in which the device is partially pivoted from the vertical to the horizontal position.
Figure 8:
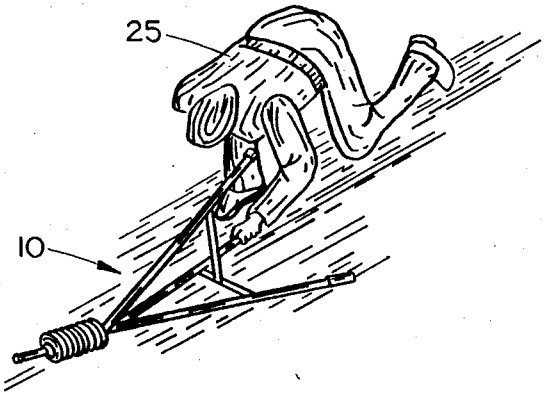
FIG. 8 is a perspective view of the device in which the user has pivoted the device from the vertical to the horizontal position.

FIGS. 6, 7 and 8 show the second major type of exercise in which the user 25 grips the device 10 and rotates it about a fulcrum 94 substantially normal to the longitudinal axis of the user's forearm 92. The user 25 rotates the device 10 from the vertical to the horizontal and then back to the vertical in a similar manner as is depicted in FIGS. 3, 4 and 5.

In both types of exercises, a selected number of the disc weights 19 are placed on extension 23 to accommodate the particular user. He then positions the device 10 on a flat surface 66 with the lower ends of at least the two legs 12 and 13 engaging the flat surface 66 and thereby creating a fulcrum between the points of intersection of the flat surface 66 and lower ends 44 and 48 of the two legs 12 and 13. In the horizontal position of the device 10, only two legs will engage the flat surface whereas, in the vertical position of FIGS. 3 and 6, all three legs engage the flat surface. The user then grips one of the two legs 12 and 13 at the lower end thereof and rotates the device about the fulcrum, thereby vertically moving the disc weights 19 and exercising at least the grip and wrist of the arm 92 which is gripping the device.

An important feature and advantage of the present invention is that the weights 19 are supported in a stable rest position at both the upper and lower extents of movement of the device. In the standing stable position of FIGS. 3 and 6, a vertical line through the center of gravity of weights 19 will intersect at surface 66 at a position substantially centered between the lower ends 43, 44 and 48 of legs 11, 12 and 13. This is because the lower end of leg 11 is spaced sufficiently from fulcrum 94 to positively halt upward vertical movement of the device when it reaches the standing stable position. In the three leg embodiment shown, the distances between the lower ends of the three legs are preferably equal. In the lying stable position of FIGS. 5 and 8, the lower ends 44 and 48 of legs 12 and 13 engage flat surface 66 as does an upper portion of the device, in this case, the weights 19. The legs could alternately be designed or include stops for preventing engagement of the weights 19 with the flat surface 66 in the lying stable position of the device.

The method and apparatus of the invention are intended for use in a totally new sport in which individuals and teams compete against time, themselves, each other, and in all cases, against gravity. The events of this sport are briefly described as follows.

The first event is Casting. In a sitting or standing position, the user's arms are stretched forward with elbows locked and with each hand grasping one of the hand grips 17 and with the device in a vertical position. The user then pivotally lowers the device to a horizontal position in a casting movement and then returns the device to the original vertical position without movement of the elbows and with the arms maintained forward and horizontal. Only wrist movement is allowed in the Casting event.

The second event is the Front Lift. This event starts with the user and device in the FIG. 8 positions and is completed when the device is raised to the standing stable position of FIG. 6. Both arms are judged in this event one at a time. Athletes can thereby become more ambidextrous.

The third event is Boom-er Down. This event is electronically timed by timer 74 upon actuation by mercury switch 68. The device and user begin in the FIG. 6 position whereupon the device is pivotally lowered as indicated in FIG. 7 to the solid line position indicated in FIG. 11, whereupon mercury switch 68 will close and start timer 74. The device 10 is held in this position for as long as possible and is then returned to the FIG. 6 position. Disqualification occurs if the weights or an upper portion of the device 10 contacts the support surface. The winner of this event is determined by a combination of the time shown on timer 74 and the number of weights used.

The next event is the Sidewinder Pronation. This event starts with the device and user in the FIG. 5 positions with the user's hand arranged palm up. The device 10 is raised through the FIG. 4 position to the standing stable position of FIG. 3. This may also be a timed event.

The Sidewinder Supination event is the same as the prior event, except that instead of using the left arm with palm up as shown in FIG. 5, the user would use his right arm with the palm facing down. Pronation refers to a movement of the wrist wherein the thumb is moved from an outer position upwardly and toward the body whereas supination refers to a movement of the wrist wherein the thumb is moved away from the body.

This sport is designed for all athletes, men and women. Competition is facilitated by dividing participants into weight categories such as the following: 100 pounds, 112, 118, 126, 136, 146, 156, 166, 176, 190, 225 and super heavy weight. The 100 pound category includes all weights up to and including 100 pounds. The 112 pound category includes all weights over 100 pounds and up to and including 112 pounds, etc.

Specific dimensions are not critical to the present invention although it is preferred that the lowermost weight be situated approximately 36 inches above the support surface in the standing stable position so that a device is provided which takes up no more room than a small stool and yet which affords a sufficiently visible range of movement. The invention can be more appropriately characterized in terms of a range of torque achieved by the structure and use. The following table illustrates that the apparatus should be capable of slight incremental weight adjustments to effect a required range of torque from approximately 0 to 30 footpounds.

| Number of Disc Weights | Weight Pounds | Height of center of gravity of Weights Feet | Torque Footpounds |
|---|---|---|---|
| 5 | .5 | 3.0625 | 1.531 |
| 10 | 1 | 3.125 | 3.125 |
| 15 | 1.5 | 3.1875 | 4.781 |
| 20 | 2 | 3.250 | 6.5 |
| 25 | 2.5 | 3.3125 | 8.281 |
| 30 | 3 | 3.375 | 10.125 |
| 35 | 3.5 | 3.4375 | 12.031 |
| 40 | 4 | 3.5 | 14 |
| 45 | 4.5 | 3.5625 | 16.031 |
| 50 | 5 | 3.625 | 18.125 |
| 55 | 5.5 | 3.6875 | 20.281 |
| 60 | 6 | 3.75 | 22.5 |
| 65 | 6.5 | 3.8125 | 24.781 |
| 70 | 7 | 3.875 | 27.125 |

The present invention is ideally suited for developing strength in the upper body of children due to the suitable minimal torque requirements and capability for small incremental weight variances. For the same reasons, the invention is readily suited for use in physical therapy in hospitals, nursing homes and the like. Even handicapped persons in wheelchairs can readily participate in this sport by using a tabletop for the support surface indicated in the drawings. Whereas there are so few sports for blind people to participate in, they can compete on equal terms with persons with sight in the sport using this invention.

It has been found that the present invention does not build bulky tight muscles. Rather, it tones the muscles and does not alter the skills which an athlete requires for golf, tennis, baseball, etc. The muscles are toned yet supple so as not to slow the speed of the hands or arms.

Whereas the invention has been shown and described in connection with preferred embodiments thereof, it is apparent that many modifications, substitutions and additions may be made which are within the intended broad scope of the appended claims.

I claim:

1. A method of strengthening one's grip, wrist, arm and back, comprising, providing an exercise device including at least three legs connected together at the upper ends thereof and an elongated extension projecting upwardly from the connected upper ends and a plurality of light incremental disc weights having center openings, placing a selected number of said disc weights on said extension so that said extension extends through the center openings of the disc weights, positioning the device on a flat surface with the lower ends of at least two legs engaging said flat surface thereby creating a fulcrum between the points of intersection of said flat surface and the lower ends of said two legs, gripping one of said two legs at the lower end thereof, and rotating the device about said fulcrum, thereby vertically moving said disc weights and exercising at least the grip and wrist of the arm gripping said one of two legs.

2. The method of claim 1 wherein rotating the device about said fulcrum includes rotating the device between a standing stable position wherein the lower ends of said three legs all engage said flat surface and a lying stable position wherein the lower ends of said two legs and an upper portion of the device all engage said flat surface.

3. The method of claim 2 further comprising placing the forearm of the user's gripping arm on said flat surface and positioning the device so that said fulcrum is generally normal to the longitudinal axis of the user's forearm.

4. The method of claim 2 further comprising placing the forearm of the user's gripping arm on said flat surface and positioning the device so that said fulcrum is generally colinear with the longitudinal axis of the user's forearm.

5. The method of claim 4 wherein said positioning step includes positioning the device in the lying stable position, and the gripping step includes gripping said one leg with the user's palm up and rotating said device from the lying stable position to the standing stable position thereof by pronation of the user's wrist.

6. The method of claim 4 wherein the positioning step includes positioning the device in the lying stable position, and the gripping step includes gripping said one leg with the user's palm down and rotating said device from the lying stable position to the standing stable position thereof by supination of the user's wrist.

7. The method of claim 1 further comprising removably securing said disc weights onto said extension.

8. The method of claim 1 further comprising providing hand grip caps on the lower ends of said two legs and said gripping step includes gripping one of said hand grip caps.

9. An exercise device for strengthening one's grip, wrist, arms and back, comprising, a frame means including first, second and third elongate members, each having upper and lower ends, said three elongate members being connected together adjacent the upper ends thereof, said lower ends extending downwardly from said connected upper ends, and terminating in three support points arranged to provide a stable standing frame means upon engagement of said three support points on a flat surface, a weight attachment means comprising an elongated extension projecting upwardly from said connected upper ends of said elongate members in the stable standing position of said frame means, a plurality of light incremental disc weights having center openings therein, said disc weights being supported in stacked relation on said extension with said extension extended through said center openings, means for limiting downward axial movement of said disc weights on said extension, said disc weights being removably positioned on said extension to thereby accommodate incremental weight variations for a generally 90° pivotal movement of the device about an axis extended between the support points of two elongate members by various users using only a single handed grip on one of said two elongate members adjacent the support point thereof, and an inclination sensitive electrical switch mounted on said device, said device being pivotal between said standing stable position and a lying stable position wherein the support points of two elongate members and an upper portion of the device all engage said flat surface, said switch being operative to close upon downward pivotal movement of said device to a position adjacent to but spaced above said lying stable position.

10. The exercise device of claim 9 wherein said electrical switch is a mercury switch.

11. An exercise device for strengthening one's grip, wrist, arms and back, comprising, a frame means including first, second and third elongate members, each having upper and lower ends, said three elongate members being connected together adjacent the upper ends thereof, said lower ends extending downwardly from said connected upper ends, and terminating in three support points arranged to provide a stable standing frame means upon engagement of said three support points on a flat surface, a weight attachment means comprising an elongated extension projecting upwardly from said connected upper ends of said elongate members in the stable standing position of said frame means, a plurality of light incremental disc weights having center openings therein, said disc weights being supported in stacked relation on said extension with said extension extended through said center openings, means for limiting downward axial movement of said disc weights on said extension, said disc weights being removably positioned on said extension to thereby accommodate incremental weight variations for a generally 90 degree pivotal movement of the device about an axis extended between the support points of two elongate members by various users using only a single handed grip on one of said two elongate members adjacent the support point thereof, and an inclination sensitive electrical switch mounted on said device, said device being pivotal between said standing stable position and a lying stable position wherein the support points of two elongate members and an upper portion of the device all engage said flat surface, said switch being operative to close upon downward pivotal movement of said device to a working position adjacent to but spaced above said lying stable position, said electrical switch being connected into a circuit including an electrically actuated timing device, means for connecting said circuit to a source of electric power and said timing device being actuated by said inclination sensitive electrical switch to indicate the duration of time that said device is held in the working position thereof.

* * * * *